US009609944B2

(12) United States Patent
Diaz et al.

(10) Patent No.: US 9,609,944 B2
(45) Date of Patent: Apr. 4, 2017

(54) MODULAR PORTABLE BAR SYSTEM

(71) Applicants: Marisol Diaz, Tinton Falls, NJ (US); Juan M Diaz, Tinton Falls, NJ (US)

(72) Inventors: Marisol Diaz, Tinton Falls, NJ (US); Juan M Diaz, Tinton Falls, NJ (US)

(73) Assignee: Paul David Partywares LLC, Shrewsbury, NJ (US)

( * ) Notice: Subject to any disclaimer, the term of this patent is extended or adjusted under 35 U.S.C. 154(b) by 0 days.

(21) Appl. No.: 15/002,698

(22) Filed: Jan. 21, 2016

(65) Prior Publication Data

US 2016/0242538 A1 Aug. 25, 2016

Related U.S. Application Data

(60) Provisional application No. 62/118,566, filed on Feb. 20, 2015.

(51) Int. Cl.

| | |
|---|---|
| ***A47B 85/00*** | (2006.01) |
| ***A47B 3/06*** | (2006.01) |
| ***A47B 87/00*** | (2006.01) |

(52) U.S. Cl.

CPC ..... *A47B 3/06* (2013.01); *A47B 87/002* (2013.01)

(58) Field of Classification Search

CPC ..... A47B 87/002; A47B 31/00; A47B 83/04; A47B 3/06; A47B 2031/003

See application file for complete search history.

(56) References Cited

U.S. PATENT DOCUMENTS

| | | | | | |
|---|---|---|---|---|---|
| 2,411,620 | A | * | 11/1946 | English | A47B 43/02 312/140.2 |
| 2,419,766 | A | * | 4/1947 | Domash | A47B 31/00 312/107 |
| 2,771,334 | A | * | 11/1956 | Wahlbom | A47B 69/00 108/166 |
| 3,033,632 | A | * | 5/1962 | Felten | A47B 43/00 16/221 |
| 3,140,133 | A | * | 7/1964 | Kraft | A47B 69/00 312/140.2 |
| 3,596,297 | A | * | 8/1971 | James | A47B 83/00 312/111 |
| 3,841,728 | A | * | 10/1974 | Petersen | A47B 69/00 108/159 |

(Continued)

FOREIGN PATENT DOCUMENTS

| | | |
|---|---|---|
| EP | 0706771 | 4/1996 |
| GB | 2328373 | 2/1999 |
| WO | 9515707 | 6/1995 |
| WO | 2006087012 | 8/2006 |
| WO | 2007119256 | 10/2007 |

*Primary Examiner* — Hanh V Tran

(74) *Attorney, Agent, or Firm* — Gearhart Law LLC

(57) ABSTRACT

There is a modular furniture system having at least one wall, at least two support units, and at least one counter unit. The wall unit typically has a front surface, a back surface, and at least a first support tab and a second support tab. Each of the support units is capable of being coupled or joined to the wall unit. The counter unit can then be rested upon the wall unit and support units. Any number of wall units, support units, and counter units may be used in constructing the furniture system. The wall units and counter units may be curved or straight or bear other shapes to create unique overall pieces of furniture. In some embodiments, the furniture system may manifest itself as a portable bar.

21 Claims, 8 Drawing Sheets

(56) References Cited

U.S. PATENT DOCUMENTS

| | | | | |
|---|---|---|---|---|
| 3,983,583 | A | 10/1976 | Herman et al. | |
| 4,936,228 | A | 6/1990 | Capo | |
| 5,176,435 | A | 1/1993 | Pipkens | |
| 5,184,886 | A | 2/1993 | Handley et al. | |
| 5,251,790 | A | 10/1993 | Cohn et al. | |
| 5,382,087 | A * | 1/1995 | Pouch | A47B 73/00 160/135 |
| 5,704,699 | A * | 1/1998 | Pagelow | A47B 47/05 312/111 |
| 6,131,929 | A | 10/2000 | Haley | |
| 7,014,267 | B1 | 3/2006 | Nagar | |
| 7,207,636 | B2 | 4/2007 | Livingston et al. | |
| 7,497,531 | B2 | 3/2009 | Gross | |
| 8,267,490 | B2 * | 9/2012 | DeMars | A47F 9/00 108/115 |
| 8,468,956 | B2 * | 6/2013 | Parizek | A47B 3/12 108/157.16 |
| 8,511,293 | B2 | 8/2013 | Thompson et al. | |
| 8,579,388 | B2 | 11/2013 | Centazzo et al. | |
| 8,740,318 | B2 * | 6/2014 | DeMars | A47F 9/00 312/140.2 |
| 8,833,271 | B2 | 9/2014 | Everett | |
| 2002/0178670 | A1 | 12/2002 | D'Urbino et al. | |
| 2005/0274305 | A1 * | 12/2005 | McLamb | A47B 3/06 108/180 |
| 2012/0153782 | A1 | 6/2012 | Fraser | |
| 2014/0049141 | A1 | 2/2014 | Patel et al. | |

* cited by examiner

MODULAR PORTABLE BAR SYSTEM

CLAIM OF PRIORITY

This application claims the priority of U.S. Ser. No. 62/118,566 filed on Feb. 20, 2015, the contents of which are fully incorporated herein by reference.

FIELD OF THE EMBODIMENTS

The field of the invention and its embodiments relate to modular furniture that may be readily assembled and disassembled as needed, namely modular wet or dry bar set ups. Further, the present invention and its embodiments enable a modular piece of furniture to appear as if it is a permanent structure in virtually any setting.

BACKGROUND OF THE EMBODIMENTS

The term "modular furniture" most often refers to premade furniture units that can be combined in different ways to furnish a space whether it be a home, office, or other environment. Thus, a bed may have differing frame, headboard, and base board options that all are compatible with one another to create a particular look and feel. Further, these modular units can be easy to install and can often be less expensive than their stock or non-customizable counterparts. Currently, many modular furniture systems manifest themselves in the way of kitchen, bedroom, and office furniture. However, there is a need to expand this modular principle to other mediums and applications.

Bars or taverns have long been a popular hang-out for people seeking to watch sporting events with friends or simply relax in the company of others. Most social functions, whether it be a wedding, office party or the like, typically have a bar area set up for the patrons. Typically, wet or dry bars present in a bar or tavern will be constructed of heavy, solid wood with a counter top resting thereon. There may be dedicated places for resting one's arms, legs, drinks and other food items on the bar surface. The bar may have a serving area and a preparation area so as not to contaminate the serving area with spilled liquids and various other sticky or undesired substances. Bars can also accommodate a number of patrons simultaneously as there is plentiful counter space. In addition to providing a serving area and occupying little space, bars can also serve to enhance the surrounding environment by lending to the aesthetics of a space. However, done incorrectly such a set up may look cheap and out of place.

Duplication of a solid wood appearance and features of a commercial bar can be prohibitively expensive, and not to mention impractical to transport. These pitfalls may motivate others to create cheap imitations comprising wood veneers which are unstable and unable to withstand the rigors of shipping and ordinary usage such as having many individuals leaning on the structure. Further, these "reproductions" do not have the look and feel of a permanent structure. There are often gaps and seams visible which detract from the overall experience and aesthetic appeal of the environment.

Thus, there is a need to create a readily portable and modular bar unit that creates the appearance of being a permanent structure. The bar unit should be capable of being arranged into virtually any required space and provide the storage and working area required of a typical bar. The present invention and its embodiments meets and exceeds these objectives.

REVIEW OF RELATED TECHNOLOGY

U.S. Pat. No. 6,131,929 pertains to a portable, modular service cart that is readily converted to a refreshment center, game table or vanity. The cart generally comprises a mobile unit having a horizontal tray and legs extending downward from corners thereof. The legs have casters located at lower ends thereof and comprise telescoping members for permitting adjustment of tray height. The tray has an upper surface with a sink and multiple wells provided therein, with some or all of the wells being removable and/or refrigerated. A collapsible faucet extends beyond the upper surface of the counter and includes a first end that extends over the sink and a second end that rests beneath the upper surface of the counter and is coupled to a water supply line. The water supply line is connected at an opposite end to a continuous, endless water source such as an outdoor faucet or spigot. A water filtering system is preferably secured to one of the legs of the mobile unit. A cover for overlying the entire upper surface of the tray is hingedly connected to the tray. The cover is deep and includes pockets, racks, straps and the like for safely securing bottles, utensils and other objects thereto. When the cover overlies the tray, the faucet is urged downward, causing the second end thereof to retract further beneath the upper surface of the tray. The flat top of the cover is a game board, such that when the cover is closed the cart is converted to a game table. In another embodiment, a mirror is provided along one or both surfaces of the top of the cover for independent living aid applications.

U.S. Pat. No. 5,184,886 pertains to a modular bar system having a decorative appearance including vertical trim strips which cover the joints between sections. The system can be adapted into a variety of configurations and shapes.

U.S. Patent Application 2002/0178670 pertains to a modular sectional structure, particularly suitable for creating furniture pieces, furniture complements, or the like such as tables, small tables, shelving, expositors, and the like, or for the creation of open or closed areas. For example, stands, boxes for fairs, exhibitions, and the like, or for the creation of partition walls, and the like, are characterized in that it comprises vertical uprights, each of which is provided in at least one position of at least one lateral fitting for the preferably removable connection of at least one horizontal transversal member, by which it can be connected with at least another vertical upright.

International Application WO1995/015707 pertains to a modular display booth unit made from an upstanding bent sheet body portion located at its top and bottom in respective depending and upstanding lips of counter top and tray portions. Inside the body portion, rails extend from side to side. Hooked ends latch into latching apertures in the side wall and the side wall of any adjacent unit to link them together. Special angled joining units are provided to allow the units to be joined to form elongate assemblies of varying configuration.

Various devices are known in the art. However, their structure and means of operation are substantially different from the present disclosure. The other inventions also fail to solve all the problems taught by the present disclosure. The present invention and its embodiments is both lightweight and portable. Further, the seamless appearance mimics that of permanent structures. At least one embodiment of this invention is presented in the drawings below and will be described in more detail herein.

SUMMARY OF THE EMBODIMENTS

Generally, the modular furniture system described herein provides for a modular, portable bar unit. The bar unit may be a wet bar or a dry bar and may accommodate refrigerators, kegs, soda guns, storage racks, and the like or any combination thereof. The present invention and its embodiments enable such a modular bar to be readily portable, yet appear to be a permanent fixture in a variety of settings. This is obtained by strategically using coupling mechanisms and precise angles and measurements to achieve a seamless appearance from any viewpoint. Further, this is achieved using limited material thereby lending towards portability.

In use, the modular, portable bar can be transported to any location to be desired. Once at the location, the combination of wall units, support units, and counter units can be employed to create a particular look in a particular space requirement. The set up and tear down can be accomplished quickly and easily and does not require undue manual labor thus enabling time constraints to be easily met. Further, this is made possible since mechanical fasteners such as nails, tacks, screws, pins, etc. are not used in the present invention to join wall units to support units or counter units thereto.

It should be appreciated that the principles described herein may be applicable to many types of furniture rather than bar units including but not limited to bedrooms, entertainment centers, office desks, school desks, cabinetry, kitchen counters, outdoor furniture, chairs, and the like or any combination thereof.

In one embodiment there is a modular furniture system having at least one wall unit having a front surface, a back surface, and at least a first support tab and a second support tab; at least two support units, wherein each of the at least two support units is capable of being coupled to the wall unit; and at least one counter unit which rests upon and/or engages at least one of the at least one wall unit or either of the at least two support units.

In another embodiment there is a modular furniture system having at least one wall unit having a front surface, a back surface, a top surface, a base, and at least a first support tab and a second support tab, wherein the back surface has at least one support rack coupled thereto, and wherein the at least one wall unit is curved or straight; at least two support units with each of the at least two support units having a top section, a body section, and a base section, wherein each of the at least two support units is capable of being coupled to the wall unit via a recess in the body section; and at least one counter unit which rests upon and/or engages at least one of the at least one wall unit or either of the at least two support units, wherein the at least one counter unit is curved or straight, and wherein there is a lip disposed on a top surface of the at least one counter unit.

In another embodiment there is a modular, portable bar having at least one wall unit having a front surface, a back surface, a top surface, a base, and at least a first coupling mechanism and a second coupling mechanism, wherein the back surface has two support racks coupled thereto, and wherein the at least one wall unit is curved and/or straight; at least two support units with each of the at least two support units having a top section, a body section, and a base section, wherein each of the at least two support units is capable of being coupled to the wall unit via a recess in the body section, and wherein the base section and the top section of the at least two support units are pyramidal frustums; at least one counter unit having a top surface, a bottom surface, and a plurality of side surfaces, the at least one counter unit resting upon at least one of the at least one wall unit or either of the at least two support units, wherein the at least one counter unit is curved and/or straight, and wherein there is a lip disposed on a top surface of the at least one counter unit; and wherein a first pair and second pair of slanted surfaces of the at least one wall unit are complementary to the top section and the base section of the at least two support units thereby forming a contiguous surface.

In another embodiment of the present invention there is a modular, portable bar having at least one straight or curved surface having a height and a length and a first coupling mechanism and a second coupling mechanism; at least two supports capable of being coupled to the at least one straight or curved surface, wherein at least one surface of each of the at least two supports is complementary to that of the at least one straight or curved surface; and a top surface supported by the at least two supports and/or the at least one straight or curved surface.

In general, the present invention succeeds in conferring the following, and others not mentioned, benefits and objectives.

It is an object of the present invention to provide a modular furniture system that can be used as a bar.

It is an object of the present invention to provide a modular furniture system that is portable and durable.

It is an object of the present invention to provide a modular furniture system that can be matched to and/or enhance the surrounding environment.

It is an object of the present invention to provide a modular furniture system that appears to be a permanent structure.

It is an object of the present invention to provide a modular furniture system that uses particular angles and mechanisms of attachment to hide joints and seams.

DESCRIPTION OF THE PREFERRED EMBODIMENTS

Figure 1:
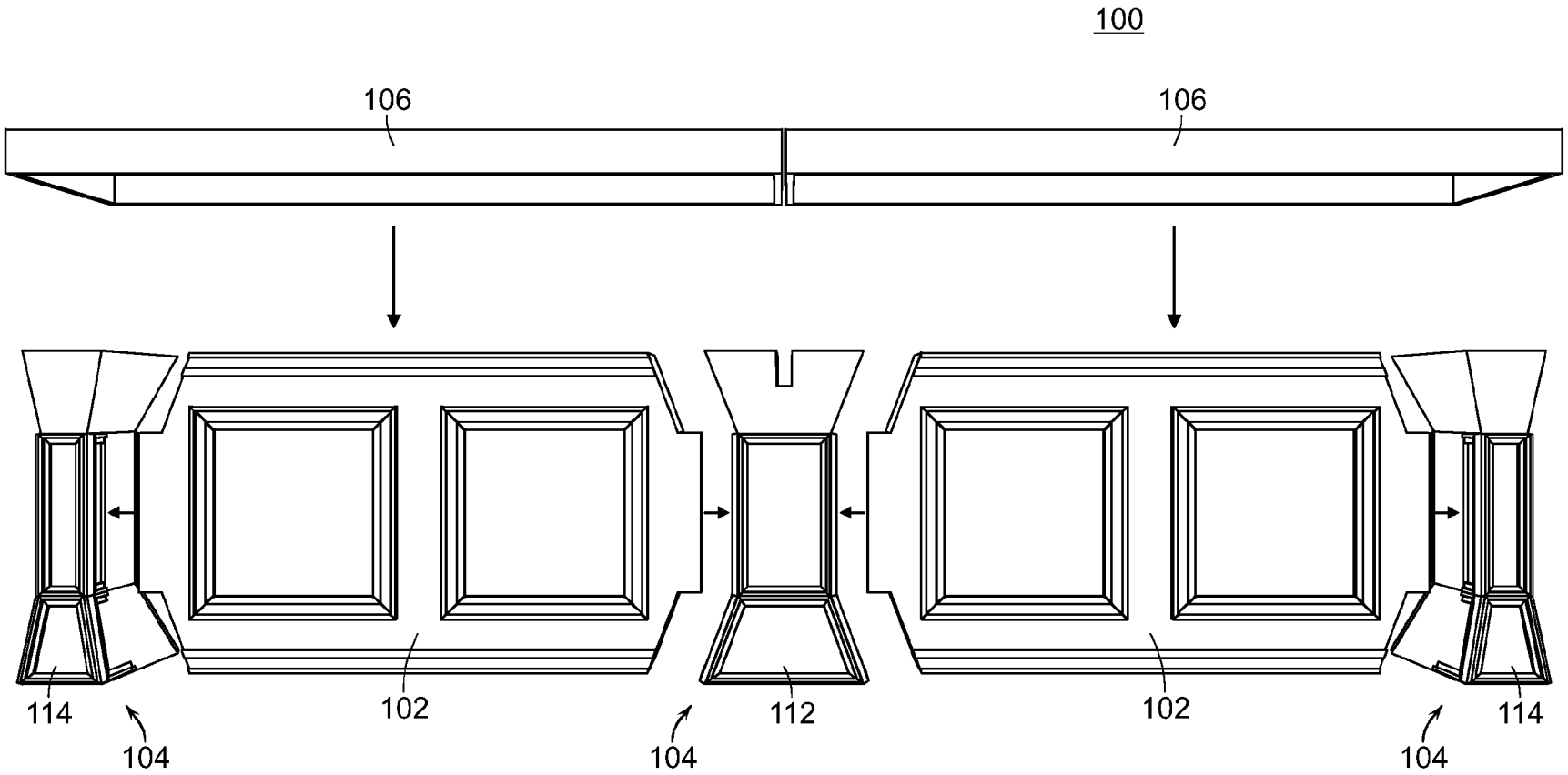
FIG. 1 is an exploded view illustrating the interrelationship of components of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, there is an exploded view of the general components of the modular furniture system 100. Typically, some combination of components may be used and may be used in varying numbers, configurations, sizes, shapes, and the like or any combination thereof. Generally, there are wall units 102, support units 104 which may be either a mid-support unit 112 or an end support unit 114, and counter units 106. The wall units 102 can be coupled to both the counter units 106 and the support units 104. The support units 104 are capable of being coupled to the counter units 106 and wall units 102.

The support units 104 are coupled to the wall units 102 via recesses 116 in the body of the support unit 104. The wall unit 102 has a first support tab 105 and a second support tab 107 which are sized to engage the recess 116. The counter unit 106 engages a separate top recess 122 in the top of the support units 104. Thus, the system 100 relies on these features to create a seamless modular furniture system 100 that requires no mechanical fasteners such as nails, screws, pin, tacks, and the like to secure the components to one another. Each of the components, their features, and interactions with one another will be described in more detail herein.

Figure 2A:
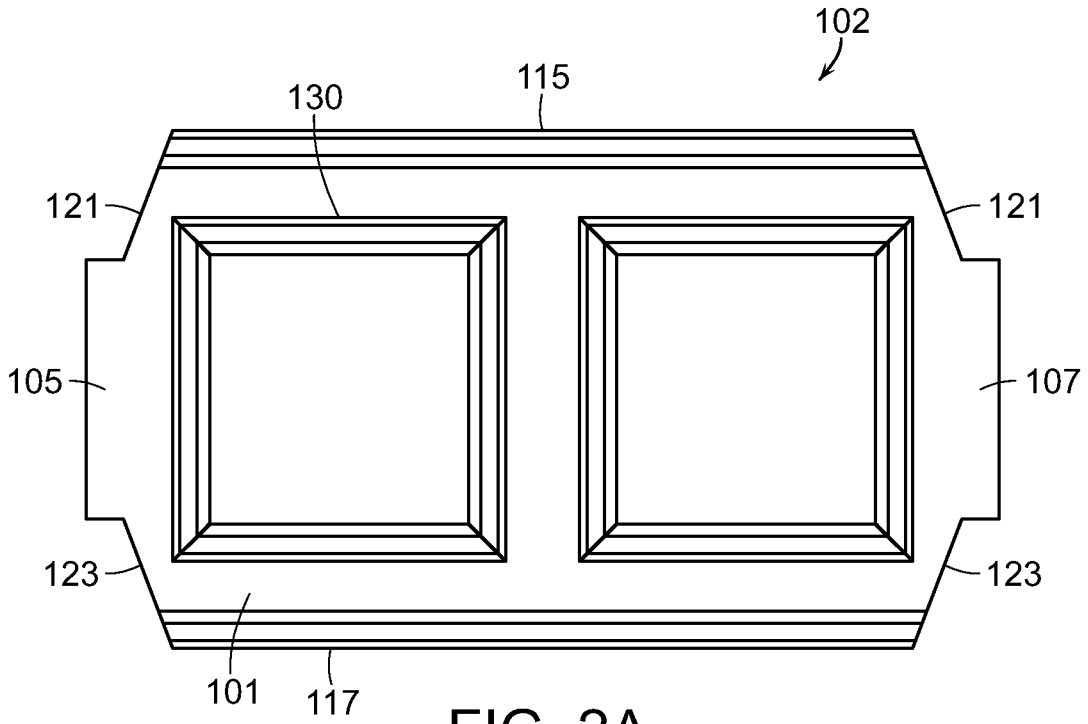
FIG. 2A is a front view of a wall unit of an embodiment of the present invention.
Figure 2B:
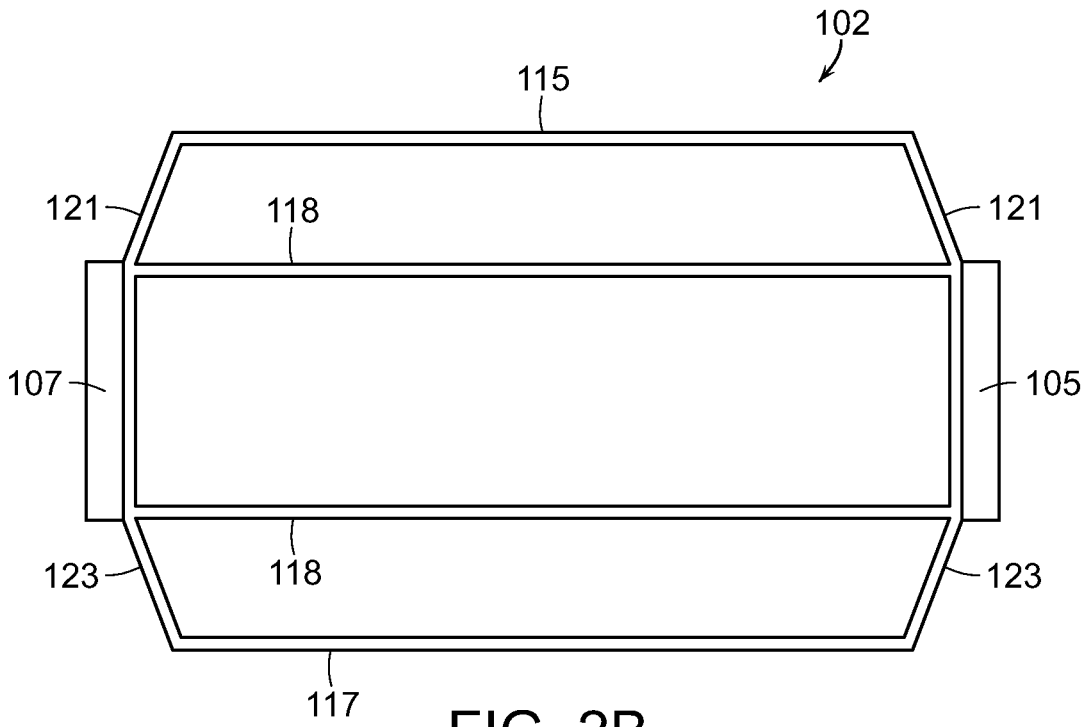
FIG. 2B is a back view of a wall unit of an embodiment of the present invention.

Referring to FIGS. 2A and 2B, there is a front view of a wall unit 102 and a back view of a wall unit 102 respectively. In FIG. 2A, the general shape formed by the wall unit 102 is apparent and generally forms a horizontally elongated octagon. The wall unit 102 has a pair of first slanted surfaces 121 and a pair of second slanted surfaces 123. These surfaces are angled to align seamlessly with the support units 104 (see FIG. 6). The two horizontal surfaces are used primarily for support (i.e. top and bottom), and the two vertical surfaces have a first support tab 105 and a second support tab 107 coupled individually coupled thereto. The support tabs are coupled to the front edge of the wall unit 102 thereby further allowing the seamless wall unit-support unit connection to occur. The tabs may be an extension of the wall unit 102 itself or may be an added and attached structure.

The wall unit 102 further has a base 117 which is rested upon the ground or floor and a top 115 which partially may or may not support the counter unit when positioned thereon. The front surface 101 of the wall unit 102 bears some ornamentation 130 thereon. The ornamentation 130 may vary and may be selected to form patterns and designs when combined with other pieces of the modular furniture system. In some instances, the wall unit 102 can be curved or straight. As shown, the wall unit 102 is straight however, in FIG. 8 the wall unit 102 is shown to be that of a curved variety. The same structural features exist in each implementation rather it is the curvature that varies.

In FIG. 2B, the wall unit 102 is shown from behind. Across the wall unit 102 are support racks 118. The support racks 118 may vary in number and spacing from one another, but should be spaced to allow for the storage of food and drink items such a liquor bottles and the like. The support racks 118 may be removable or permanent depending on the desired usage and transportation concerns.

Figure 3A:
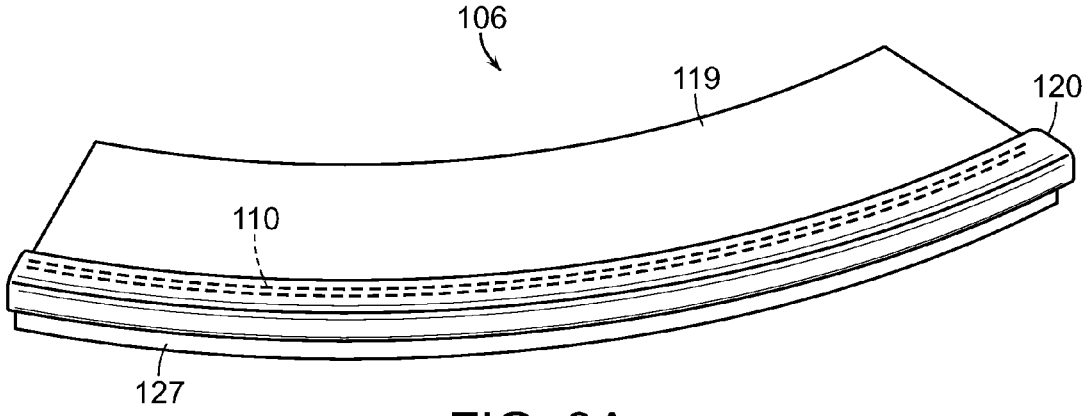
FIG. 3A is a top perspective view of a counter unit of an embodiment of the present invention.
Figure 3B:
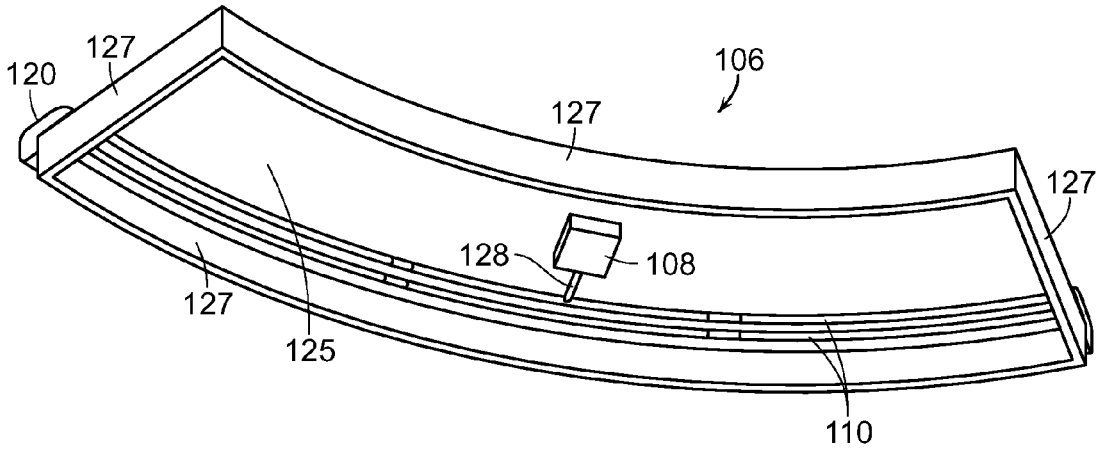
FIG. 3B is a bottom perspective view of a counter unit of an embodiment of the present invention.

In FIGS. 3A and 3B, there is a top perspective view and a bottom perspective view, respectively, of a curved counter unit 106 in accordance with the present invention. As with the wall units, the counter unit 106 may be straight or curved and an example of the straight counter unit 106 exists in at least FIGS. 1 and 10. The structural features of each remain virtually identical, but it is the shape that varies.

The counter unit 106 generally has a top surface 119, a bottom surface 125, and a plurality of side surfaces 127. The side surfaces 127 extend below the bottom surface 125 thereby providing a recessed area underneath the counter unit 106. The counter unit 106 may be either straight or curved (as shown) or take virtually any other shape. A lip 120 resides on the top surface 119 of the counter unit. The lip 120 provides a place for patrons to rest their arms when in use. Behind the lip 120 there may be a light source 110 designed to emit light thereby enhancing the aesthetics of the modular furniture system. A diffuser may be overlaid such a light source 110 to help soften the light and create a particular ambience.

In FIG. 3B, the underside of the counter unit 106 is shown and the other light sources 110 are visible. The light sources 110 are operably coupled to the power source 108 by wiring or wires 128 or other comparable means of connection. The light sources 110 may be light emitting diodes, organic light emitting diodes, or the like or any combination thereof. The light sources 110 may be capable of changing colors or having other effects such as strobing or patterned "movement" of the lights.

The power source 108 is typically a battery which may be a solid state battery or rechargeable battery. There should be at least one power source and more than one may be utilized or one power source may function as a backup in the event of failure of the main power source. The light sources 110 are preferably positioned in a recess on the bottom surface 125 of the counter unit 106 to prevent damage to the light sources 110 when positioning, transporting, and otherwise manipulating the counter unit 106.

Figure 4:
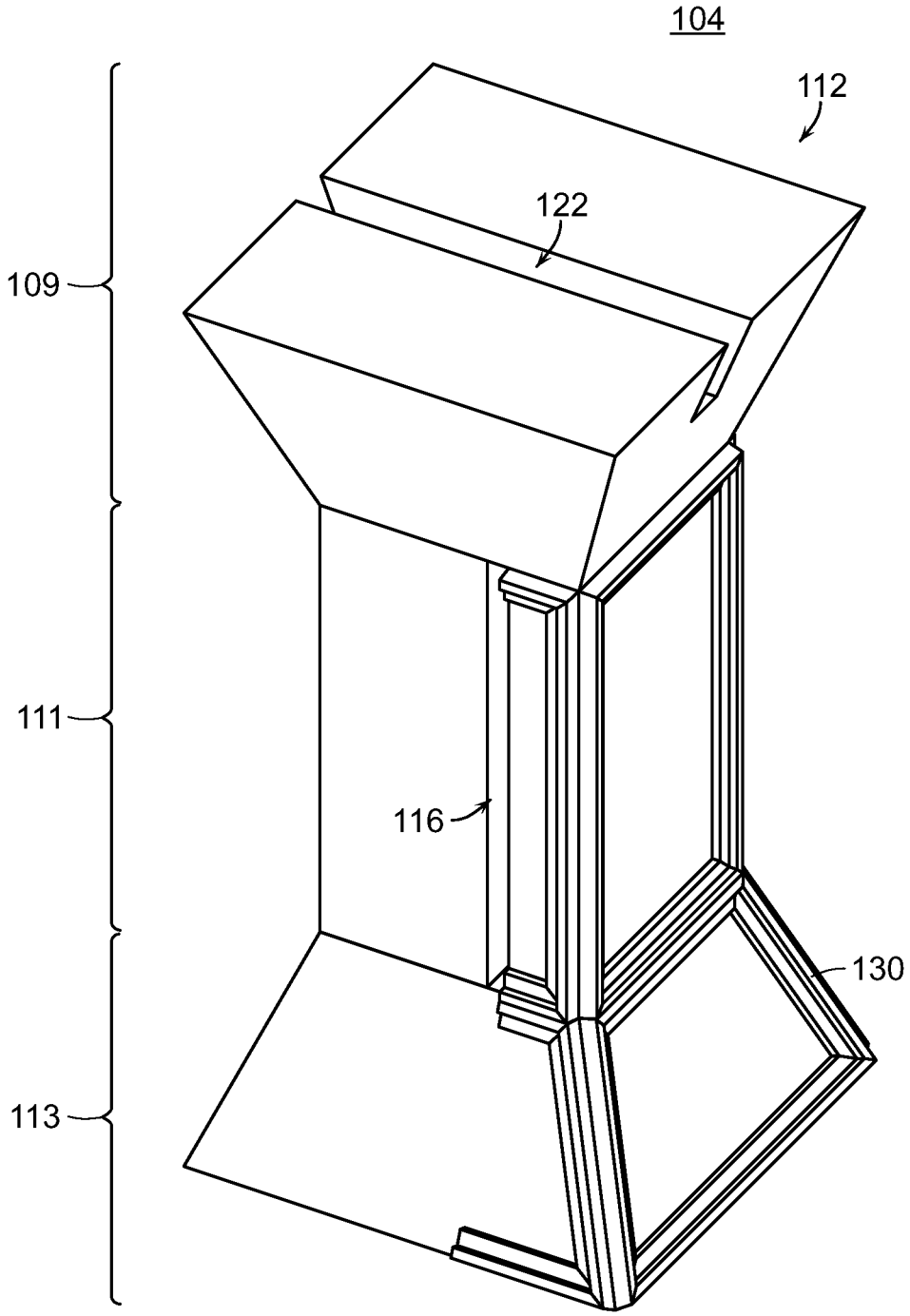
FIG. 4 is a perspective view of a full support of an embodiment of the present invention.

In FIG. 4 there is a perspective view of a support unit 104 namely a mid-support unit 112. The mid-support unit 112 has a top section 109, a body section 111, and a base section 113 as shown. Both the top section 109 and base section 113 comprise pyramidal frustums with a rectangular body section 111 positioned therebetween.

The top section 109 has a top recess 122 which is a horizontal recess that traverses at least a portion of the upper surface of the top section 122. The top recess 122 is sized to receive the thickness of two sidewalls from the counter unit as described in FIGS. 3A and 3B and further shown in FIG. 7. A body recess 116 is a vertically situated recess in the body section 111 of the mid-support 112. The ornamentation 130 of the mid-support 112 is selectively positioned to form a continuous ornamentation display with the wall unit and counter unit.

Figure 5A:
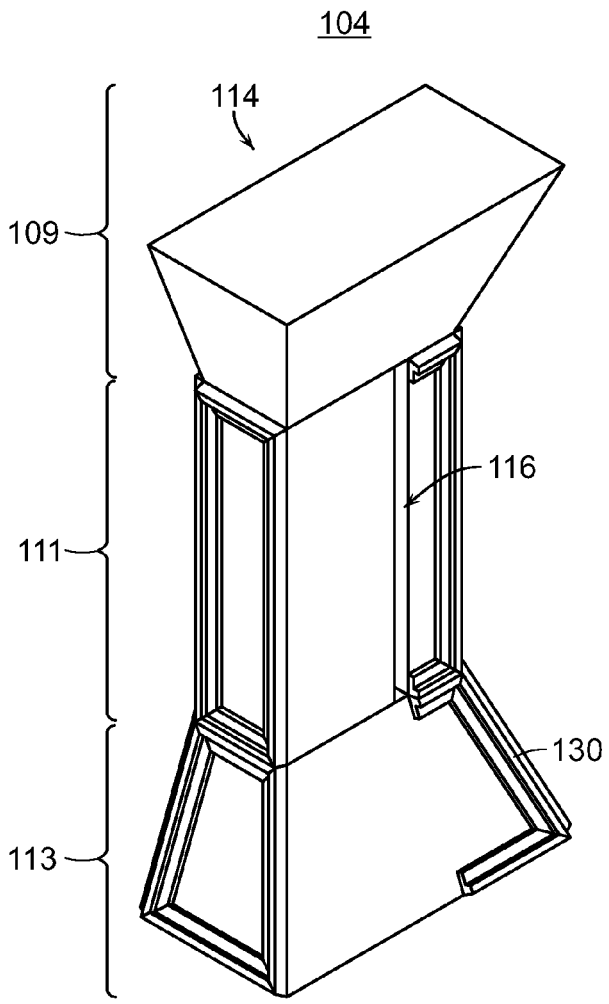
FIG. 5A is a perspective view of a half support of an embodiment of the present invention.
Figure 5B:
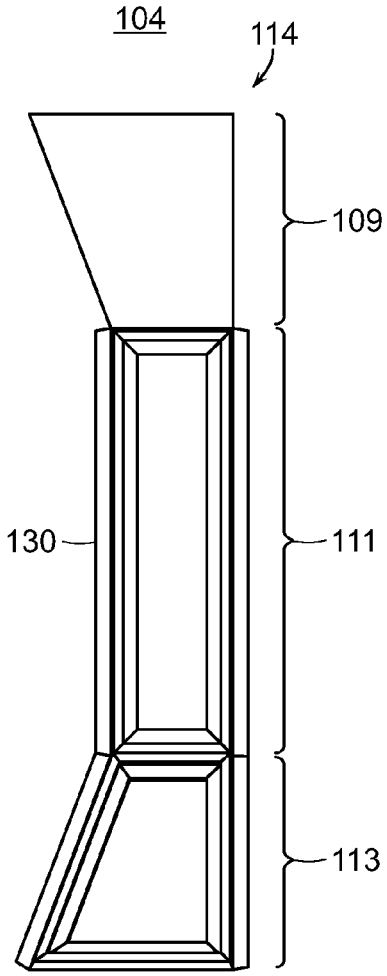
FIG. 5B is a side view of a half support of an embodiment of the present invention.

Referring now to FIGS. 5A and 5B, there is another support unit 104 namely an end support unit 114. This unit is essentially "half" a mid-support unit (see FIG. 4) and is shown in both a perspective and side view to demonstrate the shape of the unit. The end support unit 114 has again a top section 109, a body section 111, and a base section 113. A vertically situated body recess 116 provides for the coupling of the end support 114 to a wall unit 102. The ornamentation 130 is again selectively positioned to create the desired look of the system as a whole when assembled.

However, unlike the mid-support unit, the end support unit 114 has no top section recess or top recess. This is due to the intended placement of the end support unit 114. The end support 114 is intended to be positioned at a terminal end of the system and therefore the counter unit is positioned thereon and completely covers the top section 109. If such a recess was used as described with the mid-support unit, a portion of the top section 109 would remain exposed after the final set up was complete and create an artificial and undesired appearance.

Figure 6:
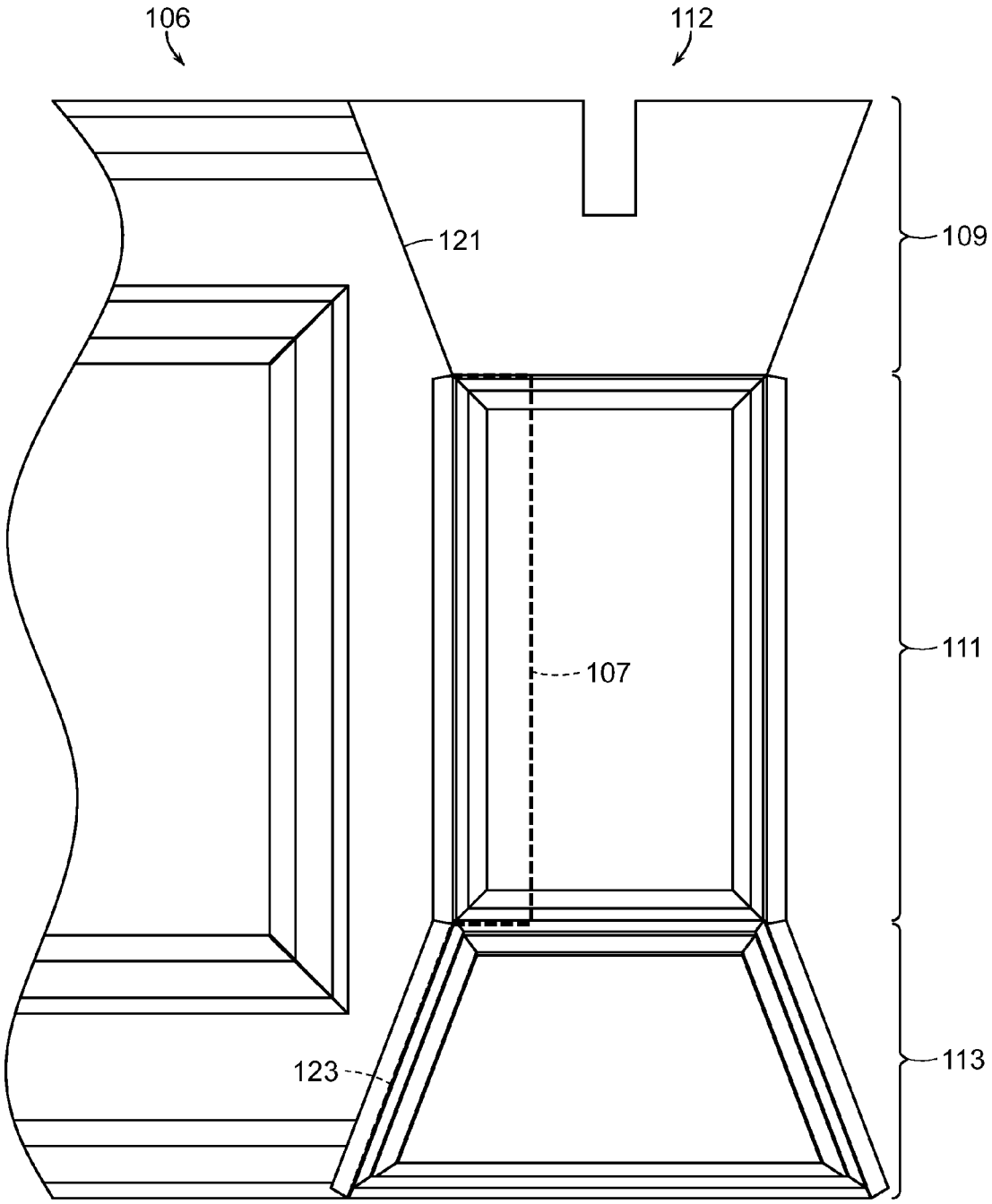
FIG. 6 is a close up view showing the joining of a wall unit and a support unit.

In FIG. 6, a wall unit 102 shown coupled to a mid-support unit 112. The second support tab 107 of the wall unit 102 has been inserted in the body recess 116 (see FIG. 4) thereby removably securing the position of the wall unit 102 and preventing unintended shifting or falling of the wall unit 102. The base section 113 and the top section 109 are shown as pyramidal frustums as previously described. The first slanted surface 121 and the second slanted surface 123 of the wall unit 102 are angled to complement that of the top section 109 and the base section 113. Typically along at least one edge, the ornamentation is used to cause a flowing effect that further hides the edges between pieces and makes it appear as one unit. This enables a "seamless" interaction between the two units.

Figure 7:
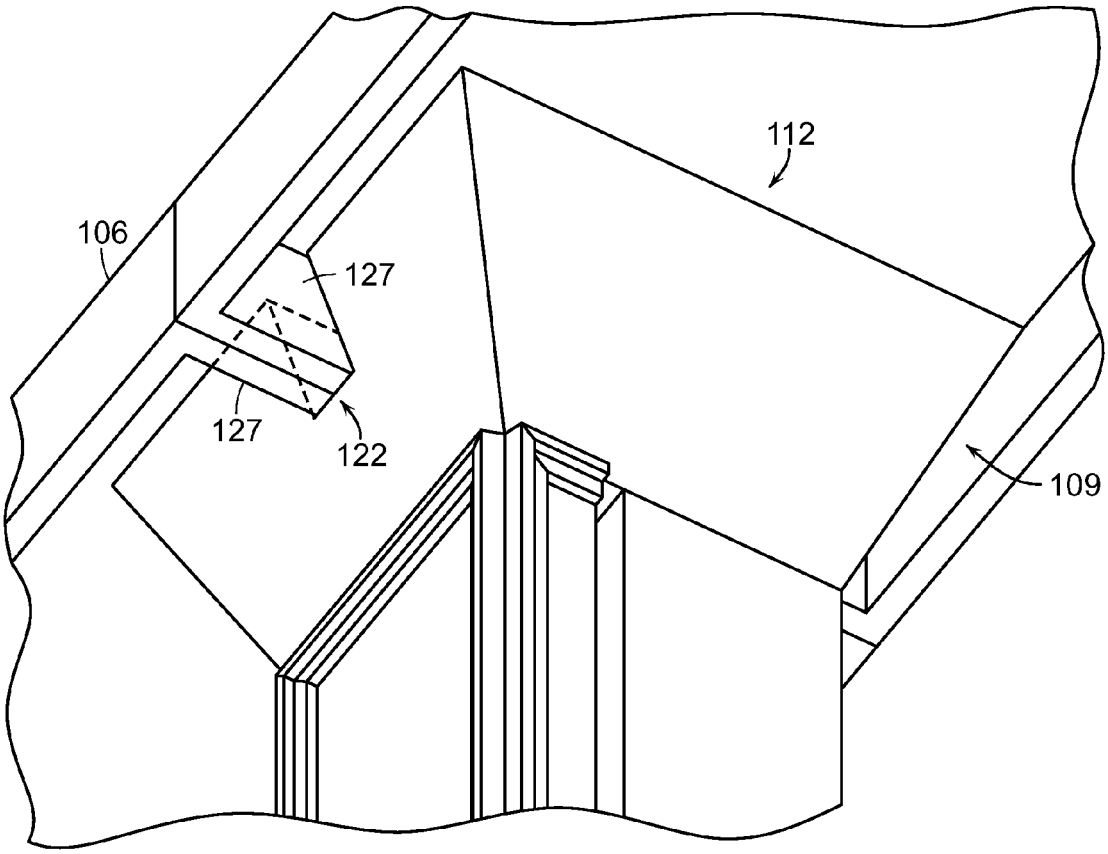
FIG. 7 is a close up view showing the joining of a counter unit and support unit.

Referring now to FIG. 7, the interaction between the counter unit(s) 106 and the support units (mid-support unit shown) is highlighted. Here, two counter units 106 are positioned to be supported by the mid-support unit 112. One of the plurality of sidewalls 127 is allowed to be positioned within the top recess 122 and reside therein. The top recess 122 is sized to enable a second sidewall 127 to then be positioned next to the first sidewall 127. Both sidewalls 127 are then in position in the top recess 122. This secures the position of the counter unit 106 and further prevents the counter units 106 from being displaced through the course of use.

Figure 8:
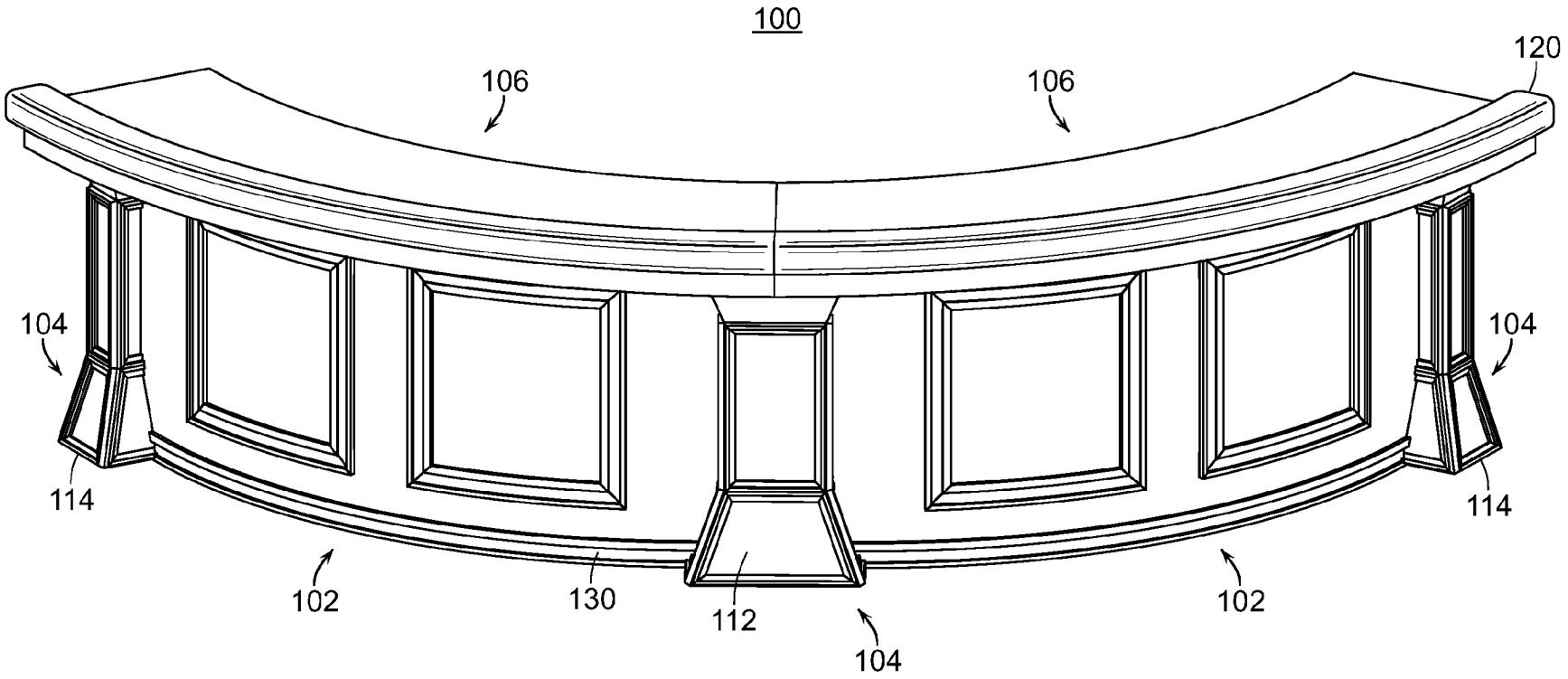
FIG. 8 is a perspective view of one implementation of the present invention.

In FIG. 8, the modular furniture system 100 has been assembled in one form of intended usage. As can be seen, two curved wall units 102, two curved counter units 106, one mid-support unit 112, and two end support units 114 have been used. The ornamentation 130 on each of the units creates the appearance of a unitary piece of furniture. Further, the lip 120 on the counter unit 106 enhances this appearance.

Virtually any combination of pieces can be used. Further, these pieces may be straight, curved, or otherwise varied to increase the flexibility of the pieces. Virtually any shape can be created including circles, quadrilaterals, semi-circles, linear, irregular, waves, and the like or any combination thereof. Further, the size of the modular furniture system may be and can comprise in its most simple arrangement two support units, a wall unit, and a counter unit. Other arrangements may range from where from about five to about a hundred total pieces of wall units, counter units, and support units.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A modular furniture system comprising:

at least one wall unit having a front surface, a back surface, a top surface, a base, and at least a first support tab and a second support tab, wherein the back surface has at least one support rack coupled thereto, and wherein the at least one wall unit is curved or straight;

at least two support units with each of the at least two support units having a top section, a body section, and a base section, wherein each of the at least two support units is capable of being coupled to the wall unit via a recess in the body section, and wherein the base section and the top section of the at least two support units are pyramidal frustums; and at least one counter unit which rests upon or engages at least one of the at least one wall unit or either of the at least two support units, wherein the at least one counter unit is curved or straight, and wherein there is a lip disposed on a top surface of the at least one counter unit.

2. The furniture system of claim 1 wherein there are two support racks coupled to the back surface of each of the wall units.

3. The furniture system of claim 1 wherein at least one of the at least two support units has a recess in the top section.

4. The furniture system of claim 1 wherein the at least one wall unit has a first pair of slanted surfaces and a second pair of slanted surfaces.

5. The furniture system of claim 4 wherein the first pair and second pair of slanted surfaces are complementary to the top section and the base section of the at least two support units.

6. The furniture system of claim 1 further comprising at least one power source and a plurality of light sources contained within the at least one counter unit.

7. The furniture system of claim 1 wherein the first tab and the second tab are extensions of or coupled to the front surface of the at least one wall unit.

8. The furniture system of claim 6 wherein the plurality of light sources are operably coupled to the at least one power source causing light to emanate therefrom.

9. A modular, portable bar comprising:

at least one straight or curved surface having a height and a length and a first coupling mechanism and a second coupling mechanism;

at least two supports capable of being coupled to the at least one straight or curved surface, wherein at least one surface of each of the at least two supports is complementary to that of the at least one straight or curved surface, and wherein the at least two supports are end support units, mid-support units, or a combination thereof, wherein the end support units and mid-support units have a top section, a base section and a body section, with the top section and the base section being pyramidal frustums, wherein the end support units have at least one recess in the body section configured to receive the first coupling mechanism or the second coupling mechanism of the at least one straight or curved surface, and wherein the mid-support units have more than one recess in the body section for receiving a first coupling mechanism or a second coupling mechanism of the at least the at least one straight or curved surface and an additional recess in a top section for receiving a top surface; and the top surface is configured to be supported by the at least two supports or the at least one straight or curved surface.

10. The bar of claim 9 wherein the at least one surface of the at least two supports is canted at about 45°.

11. A modular, portable bar comprising:

at least one wall unit having a front surface, a back surface, a top surface, a base, and at least a first coupling mechanism and a second coupling mechanism, wherein the back surface has two support racks coupled thereto, and wherein the at least one wall unit is curved or straight;

at least two support units with each of the at least two support units having a top section, a body section, and a base section, wherein each of the at least two support units is capable of being coupled to the wall unit via a recess in the body section, and wherein the base section and the top section of the at least two support units are pyramidal frustums;

at least one counter unit having a top surface, a bottom surface, and a plurality of side surfaces, the at least one counter unit resting upon at least one of the at least one wall unit or either of the at least two support units, wherein the at least one counter unit is curved or straight, and wherein there is a lip disposed on a top surface of the at least one counter unit; and wherein a first pair and second pair of slanted surfaces of the at least one wall unit are complementary to the top section and the base section of the at least two support units thereby forming a contiguous surface.

12. The bar of claim 11 wherein the first and second coupling mechanisms are support tabs.

13. The bar of claim 11 wherein at least one of the two support units is an end support unit, mid-support unit, or a combination thereof.

14. The bar of claim 11 further comprising:

a power source; and a plurality of light sources, wherein the power source is operably coupled to the plurality of light sources.

15. The bar of claim 14 wherein the plurality of light sources emit at least two different wavelengths of light.

16. The bar of claim 11 wherein if a curved counter unit is used, then a curved wall unit is used and if a straight counter unit is used, then a straight wall unit is used.

17. The bar of claim 16 wherein a combination of straight and curved pieces are interspersed with one another.

18. The bar of claim 11 wherein at least one of the plurality of sidewalls is coupled to a recess in the top of at least one of the at least two support units.

19. The bar of claim 11 wherein the bar is circular in shape.

20. The bar of claim 11 wherein the bar is wave-shaped.

21. The bar of claim 11 is wherein the bar is a quadrilateral in shape.

* * * * *